US012392485B2

(12) United States Patent
Invernizzi

(10) Patent No.: US 12,392,485 B2
(45) Date of Patent: Aug. 19, 2025

(54) AIR AND GAS FEEDER DEVICE FOR GAS BOILERS

(71) Applicant: NORDGAS S.R.L., Costa Masnaga (IT)

(72) Inventor: Gianmario Invernizzi, Lecco (IT)

(73) Assignee: NORDGAS S.R.L., Costa Masnaga (IT)

( * ) Notice: Subject to any disclaimer, the term of this patent is extended or adjusted under 35 U.S.C. 154(b) by 466 days.

(21) Appl. No.: 17/802,196

(22) PCT Filed: Feb. 4, 2021

(86) PCT No.: PCT/EP2021/052694
§ 371 (c)(1),
(2) Date: Aug. 25, 2022

(87) PCT Pub. No.: WO2021/170368
PCT Pub. Date: Sep. 2, 2021

(65) Prior Publication Data

US 2023/0358397 A1 Nov. 9, 2023

(30) Foreign Application Priority Data

Feb. 27, 2020 (IT) ..... 102020000004048

(51) Int. Cl.
*F23C 7/00* (2006.01)
*F23D 14/62* (2006.01)
*F23L 5/02* (2006.01)

(52) U.S. Cl.
CPC ..... *F23C 7/004* (2013.01); *F23D 14/62* (2013.01); *F23D 2900/14021* (2013.01); *F23D 2900/14701* (2013.01); *F23L 5/02* (2013.01)

(58) Field of Classification Search
CPC ..... F23D 14/02; F23D 14/36
See application file for complete search history.

(56) References Cited

FOREIGN PATENT DOCUMENTS

CN 209458946 U * 10/2019
DE 202004006645 U1 8/2004
(Continued)

OTHER PUBLICATIONS

International Search Report dated Apr. 15, 2021 issued in PCT/EP2021/052694.
(Continued)

*Primary Examiner* — Jorge A Pereiro
(74) *Attorney, Agent, or Firm* — Scully, Scott, Murphy & Presser, P.C.

(57) ABSTRACT

An air and gas feeder device for gas boilers, comprising an air-gas conveyance body which comprises: a boiler coupling face configured to be coupled to a boiler at an intake duct of the boiler; an air intake port connected to an air discharge opening by means of an air passage, the air discharge opening leading out from the boiler coupling face; a gas intake port, configured to be fixed to a gas dispensing duct in fluid communication with a gas discharge opening, which leads out from the boiler coupling face; wherein the air discharge opening is coaxial to, and at least partially surrounded by, the gas discharge opening; the air passage accommodates a flow diverter configured to divert an air flow in output from the air discharge opening in the direction of the gas in output from the gas discharge opening and to impart a rotation to said air flow.

9 Claims, 5 Drawing Sheets

(56) References Cited

FOREIGN PATENT DOCUMENTS

| | | | | |
|---|---|---|---|---|
| EP | 1657489 | A1 | 5/2006 | |
| WO | 2002029319 | A1 | 4/2002 | |
| WO | WO-0229319 | A1 * | 4/2002 | ..... F23D 14/64 |

OTHER PUBLICATIONS

Written Opinion dated Apr. 15, 2021 issued in PCT/EP2021/052694.
Italian Search Report and Written Opinion dated Oct. 7, 2020 issued in IT 202000004048, with partial translation.

* cited by examiner

AIR AND GAS FEEDER DEVICE FOR GAS BOILERS

The present invention relates to an air and gas feeder device for gas boilers.

As is known, in gas boilers air and gas (typically methane) are mixed in order to feed the combustion in the burner.

The air and gas are conveyed toward the burner through an intake channel provided with a fan comprising an impeller which, by rotating, draws the gas and the air toward the burner while mixing them.

The air and the gas, arriving respectively from the outside environment and from a gas supply duct (typically a hose connected to the gas distribution grid), are conveyed in the intake channel by a feeder device which is coupled to the inlet of the intake channel and is the subject matter of the present invention.

These air and gas feeder devices of a known type comprise an air intake port connected to an air discharge port by means of an air duct, and a gas intake port which is in fluid communication with a respective gas discharge port.

The gas discharge port and the air discharge port are arranged so as to lead into the intake duct of the boiler and usually are coaxial so that the air and gas flows exit from a same outflow plane, parallel to each other, toward the intake duct of the boiler.

In greater detail, generally, the air discharge port has a circular cross-section (sized as a function of the power of the boiler) and the gas discharge port has the cross-section of an annular region which surrounds the air discharge port.

In the background art, therefore, the gas and the air exit linearly from the air and gas feeder device and the mixing of the air with the gas occurs inside the intake channel as a result of the action of the impeller of the fan.

Mixing is therefore affected by the rotation rate of the impeller which, during the operating cycle of the boiler and in particular during the modulation steps, is subjected to very considerable variations (for example, passing from 14000 rpm to 600 rpm and vice versa). This aspect leads to the technical drawback consisting in that the mixing of air and gas is scarcely homogeneous over time.

Moreover, during some rotation conditions of the impeller, turbulences are created in the air and gas flow which have the disadvantageous effect of altering the homogeneity of the flame. This aspect is particularly problematic in boilers with high automation (commonly termed as "smart" boilers), in which the variations of the flame are monitored constantly and give rise to error signals or feedbacks.

More in general, in the background art, the quality of the mixing of the incoming air and gas is an aspect that can be improved.

The aim of the present invention is to provide an air and gas feeder device for gas boilers that solves the technical problem described above, obviates the drawbacks and overcomes the limitations of the background art, allowing to improve the quality of the mixing of the air and gas entering the boiler.

Within this aim, an object of the present invention is to provide an air and gas feeder device for gas boilers that is capable of ensuring a mixing of air and gas that is homogeneous over time.

Another object of the invention is to provide an air and gas feeder device for gas boilers that reduces the turbulences in the air and gas flow, allowing to improve the homogeneity of the flame.

A further object of the invention is to provide an air and gas feeder device for gas boilers that is easy to provide and economically competitive if compared with the background art.

This aim and these and other objects which will become better apparent hereinafter are achieved by an air and gas feeder device for gas boilers, comprising an air-gas conveyance body which comprises:

- a boiler coupling face configured to be coupled to a boiler at an intake duct of the boiler;
- an air intake port connected to an air discharge opening by means of an air passage, said air discharge opening leading out from said boiler coupling face;
- a gas intake port, configured to be fixed to a gas dispensing duct in fluid communication with a gas discharge opening, said gas discharge opening leading out from said boiler coupling face;
- wherein the air discharge opening is coaxial to, and at least partially surrounded by, the gas discharge opening;
- characterized in that said air passage accommodates a flow diverter configured to divert an air flow in output from the air discharge opening in the direction of the gas in output from the gas discharge opening and to impart a rotation to said air flow.

This aim and these and other objects are also achieved by a boiler described herein.

Further characteristics and advantages of the present invention will become better apparent from the description of a preferred but not exclusive embodiment of an air and gas feeder device for gas boilers, illustrated by way of non-limiting example with the aid of the accompanying drawings, wherein.

Figure 1:
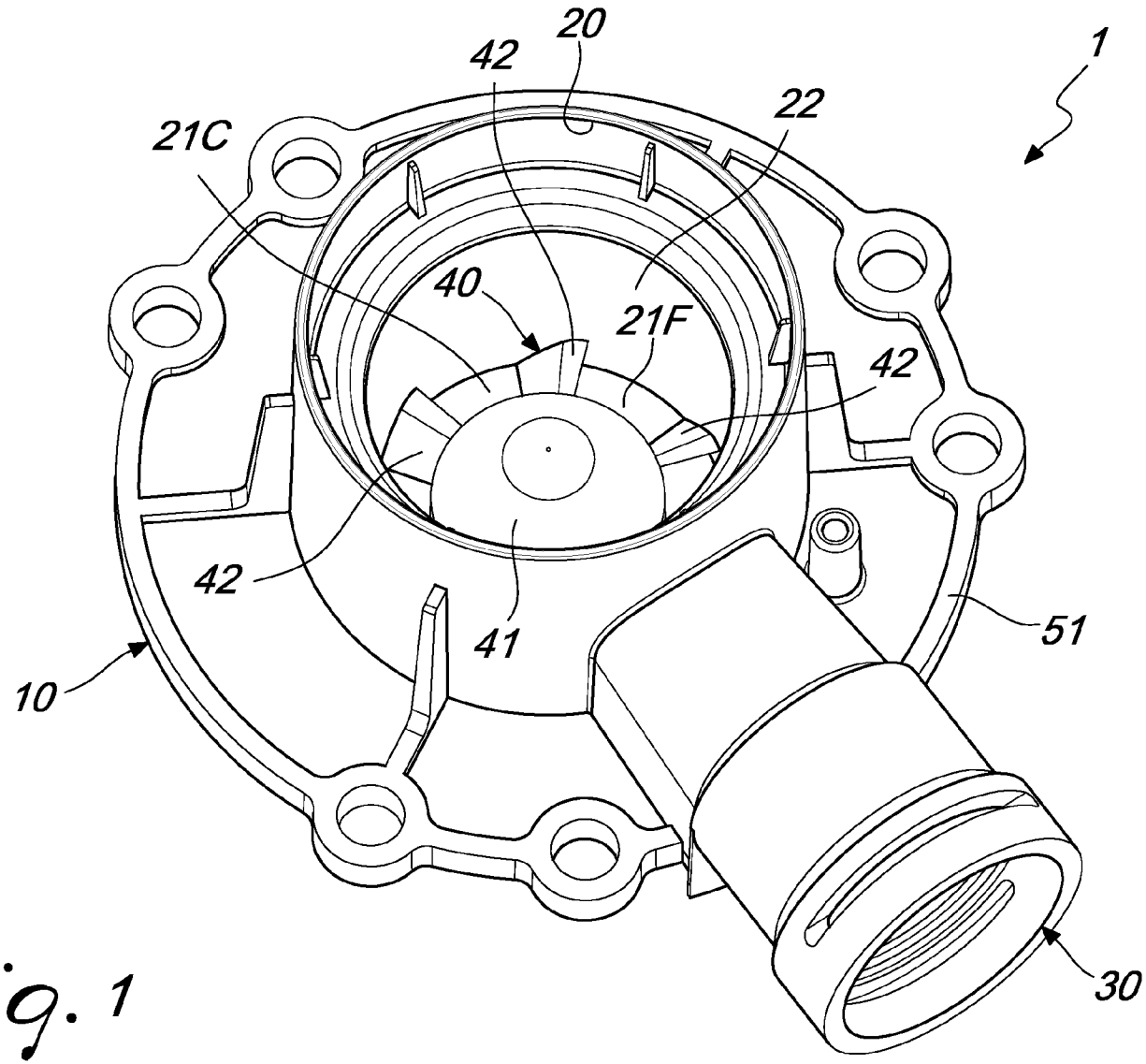
FIG. 1 is a perspective view of an air and gas feeder device for gas boilers according to the invention.
Figure 2:
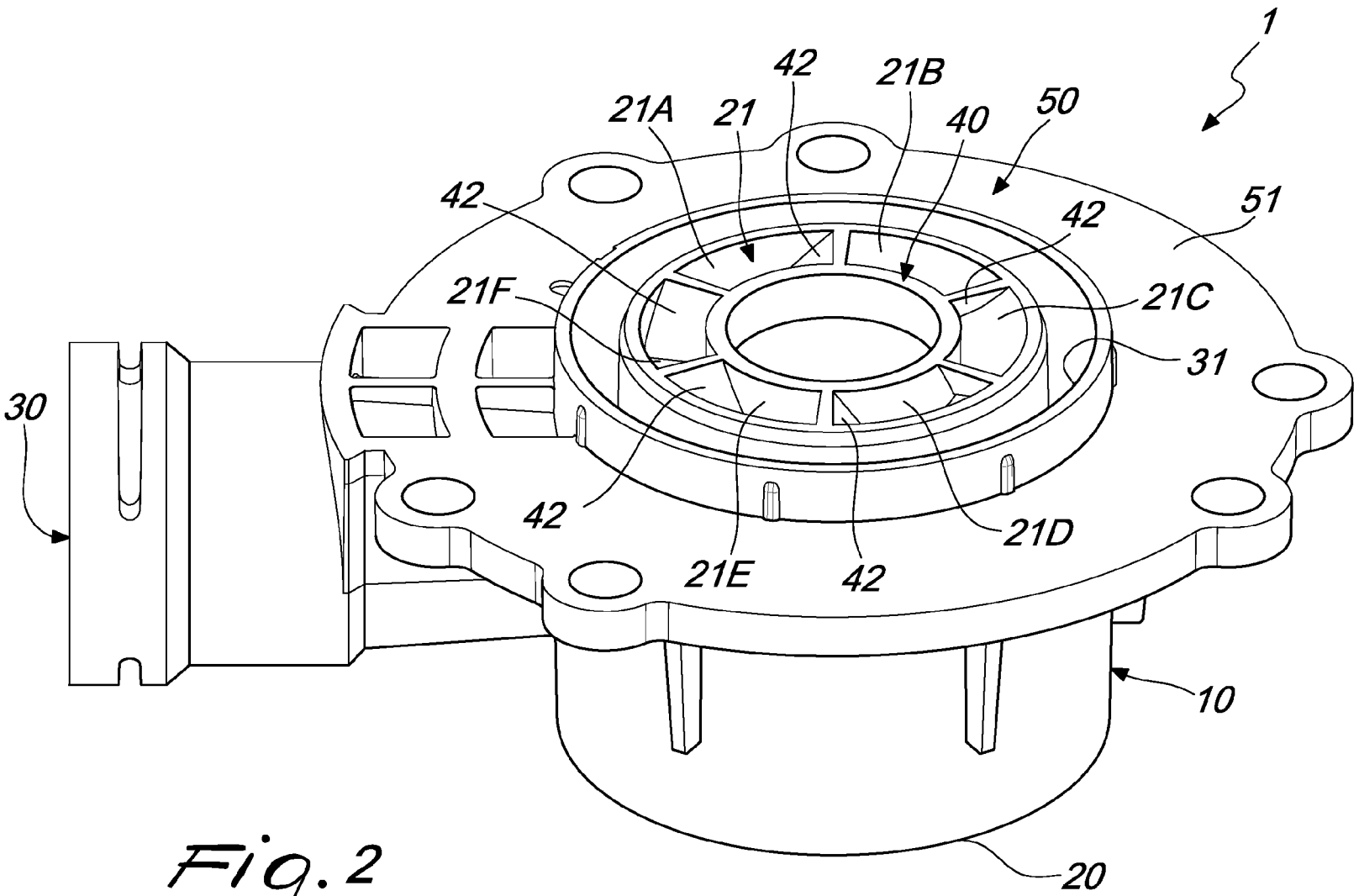
FIG. 2 is a perspective view of the feeder device of FIG. 1 from a different viewpoint.
Figure 3:
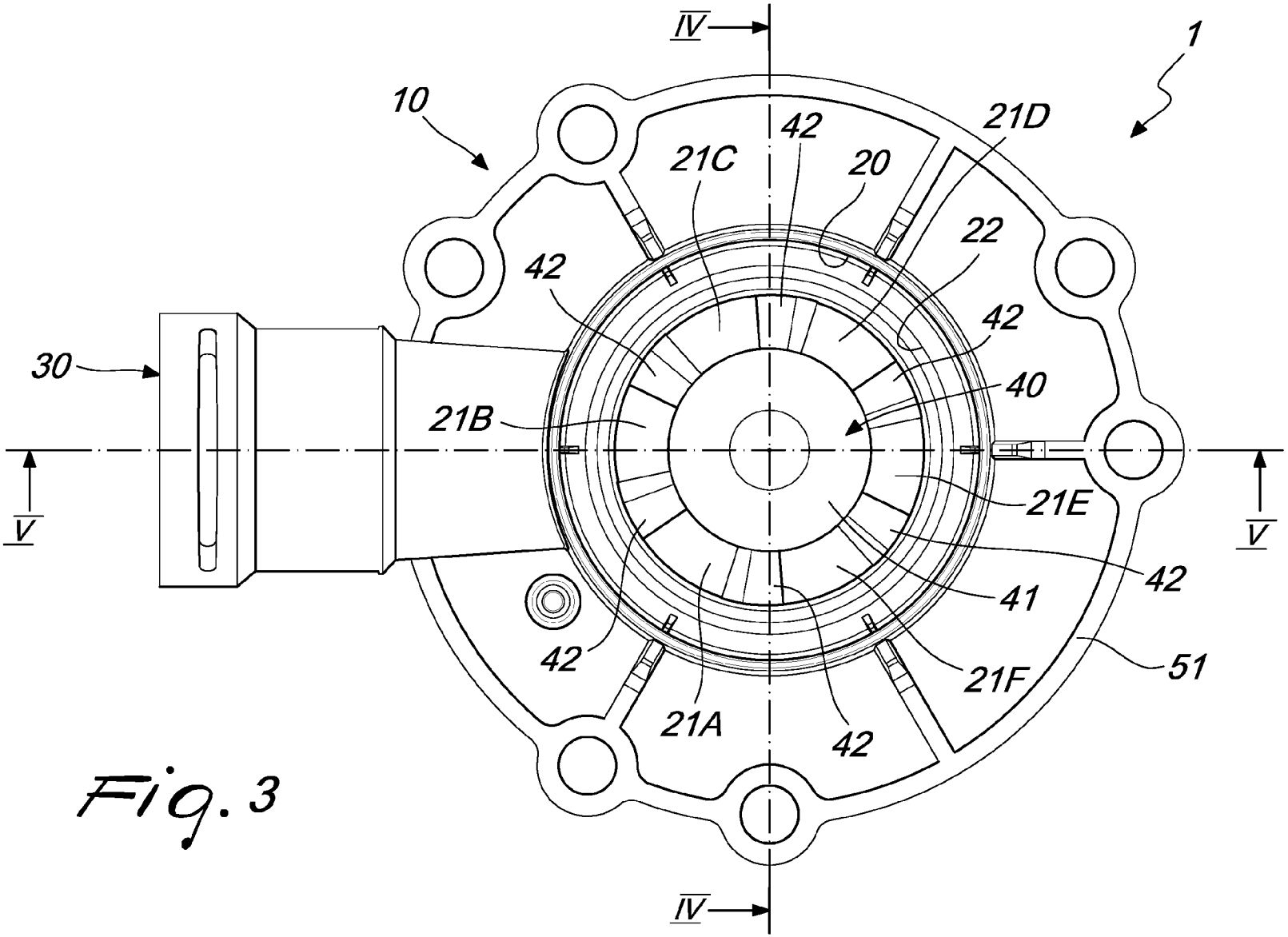
FIG. 3 is a top plan view of the feeder device of FIG. 1.

With reference to the figures, the air and gas feeder device for gas boilers, generally designated by the reference numeral 1, is configured in particular to provide the feeding of air and gas to an intake duct of a boiler of the type which normally comprises a fan provided with an impeller.

The feeder device 1 comprises an air-gas conveyance body 10 (referenced hereinafter simply as conveyance body 10), which constitutes in practice the supporting structure of the feeder device 1.

The conveyance body 10 comprises a boiler coupling face 50 configured to be coupled to a boiler at the intake duct thereof.

The boiler coupling face 50 is to be understood, in a fully general way, as the side of the conveyance body 10 that is adapted to be coupled to the boiler and for this purpose, in some embodiments including the ones shown, comprises a coupling flange 51 optionally provided with coupling holes (adapted to be engaged by screws or other fixing elements) or with other mechanical coupling means.

The conveyance body 10 further comprises an air intake port 20 adapted to allow the entry of air into the conveyance body 10.

In the preferred embodiments, the air intake port 20 is located on the opposite side of the conveyance body 10 with respect to the boiler coupling face 50 and preferably has a circular cross-section.

The air intake port 20 is connected to an air discharge opening 21 by means of an air passage 22 (i.e., a channel or duct).

The term "opening", in the present description and in the accompanying claims, means an aperture or a set of apertures allowing the passage of a fluid; for example, in some embodiments, including the one shown, the air discharge opening 21 comprises a series of separate apertures 21A, 21B, 21C, 21D, 21E, 21F which will be described in greater detail hereinafter.

The air discharge opening 21 protrudes from the boiler coupling face 50 so that when the conveyance body 10 is coupled to a boiler the air discharge opening 21 leads into the intake duct of said boiler.

The conveyance body 10 comprises furthermore a gas intake port 30 configured to be fixed to a gas dispensing duct. Preferably, the gas intake port 30 comprises a hydraulic connector provided, in a known manner, with an engagement system for a gas hose.

The gas intake port 30 is in fluid communication with a gas discharge opening 31, being for example connected thereto by means of a gas duct 32.

The gas discharge opening 31, similarly to the air discharge opening 21, protrudes from the boiler coupling face 50 so that when the conveyance body 10 is coupled to a boiler, the gas discharge opening 31 also leads into the intake duct of the boiler.

In greater detail, the air discharge opening 21 is coaxial to, and at least partially surrounded by, the gas discharge opening 31. In even greater detail, in the preferred embodiments, the air discharge opening 21 forms an annular region (in the sense that the separate apertures 21A-21F that constitute it are arranged along an annular region) and the gas discharge opening 31 has the cross-section of an annular region of greater radius, concentric to the air discharge opening 21, which surrounds completely the air discharge opening 21.

According to the invention, the air passage 22 accommodates a flow diverter 40 configured to divert the air flow (originating from the air intake port 20) in output from the air discharge opening 21.

This flow diverter 40 is conveniently arranged at the air discharge opening 21, contributing to its definition.

In greater detail, the flow diverter 40 is configured to divert the air flow that exits from the air discharge opening 21 in the direction of the gas discharge opening 31 (i.e., in the direction of the flow of gas in output therefrom) and to impart a rotation to said air flow (i.e., to impart to the flow a redirection in a transverse direction with respect to the axis of propagation of the flow so as to make the air flow assume a helical trajectory).

In the preferred embodiments, the redirection of the air flow toward the gas in output from the gas discharge opening 31 (and therefore outward) is obtained by means of a central protrusion 41, while the rotation is imparted to the air flow by means of a plurality of inclined fins 42; the central protrusion 41 and the fins 42, which are part of the flow diverter 40, will be described in greater detail hereinafter.

In practice, the air discharge opening 21 is formed between the flow diverter 40 and an internal wall of the air passage 22.

Preferably, the flow diverter 40 is arranged so as to be centered radially in the air passage 22.

As already mentioned, in the preferred embodiments, the flow diverter 40 comprises a central protrusion 41 which protrudes (projects) toward the air intake port 20 so as to divert radially outward the air that arrives from the air intake port 20.

Figure 4:
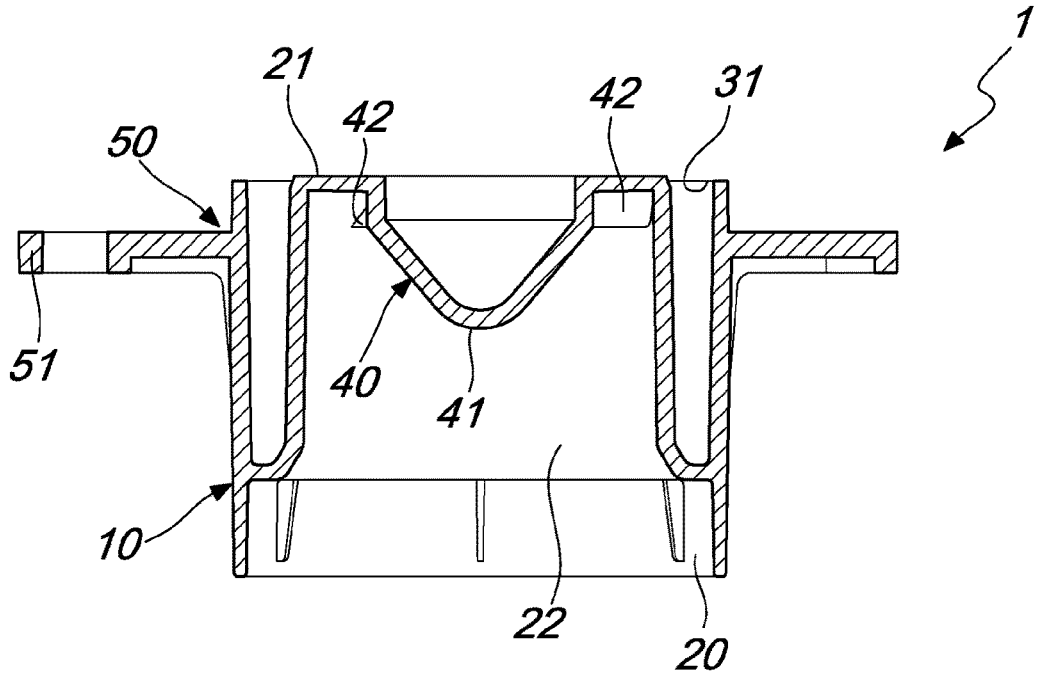
FIGS. 4 and 5 are two sectional views of the feeder device along the two mutually perpendicular different planes designated in FIG. 3.
Figure 5:
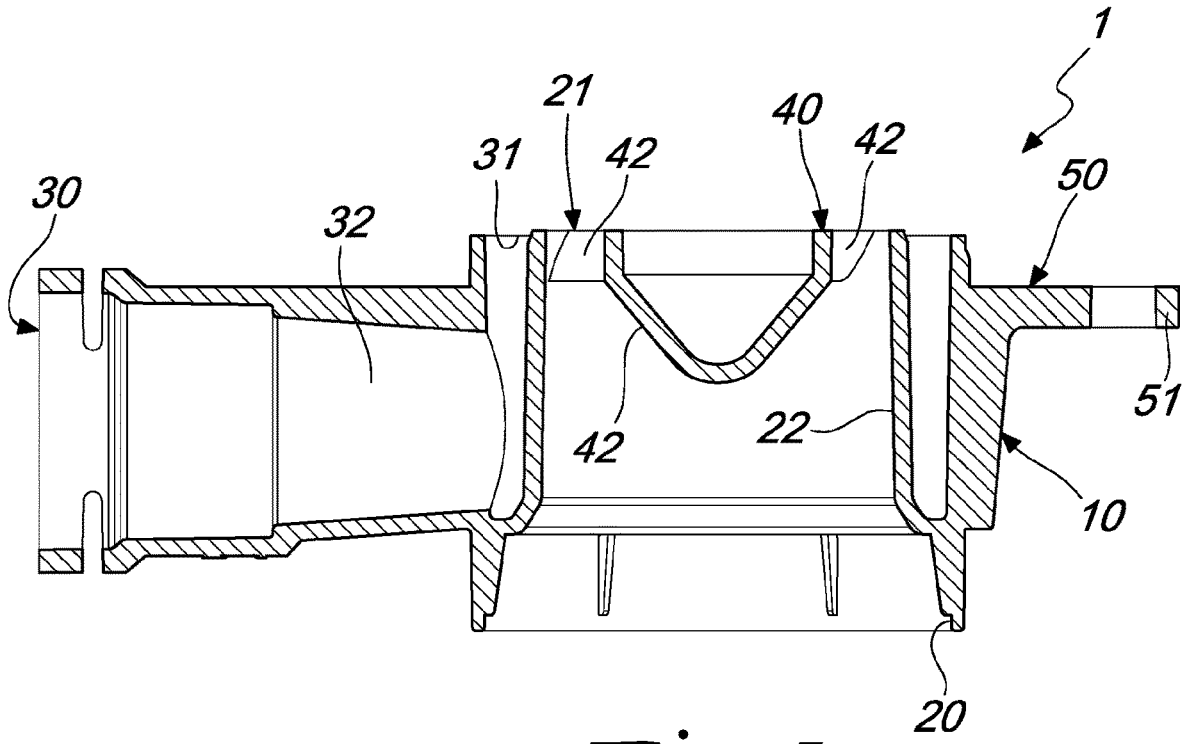
Figure 6:
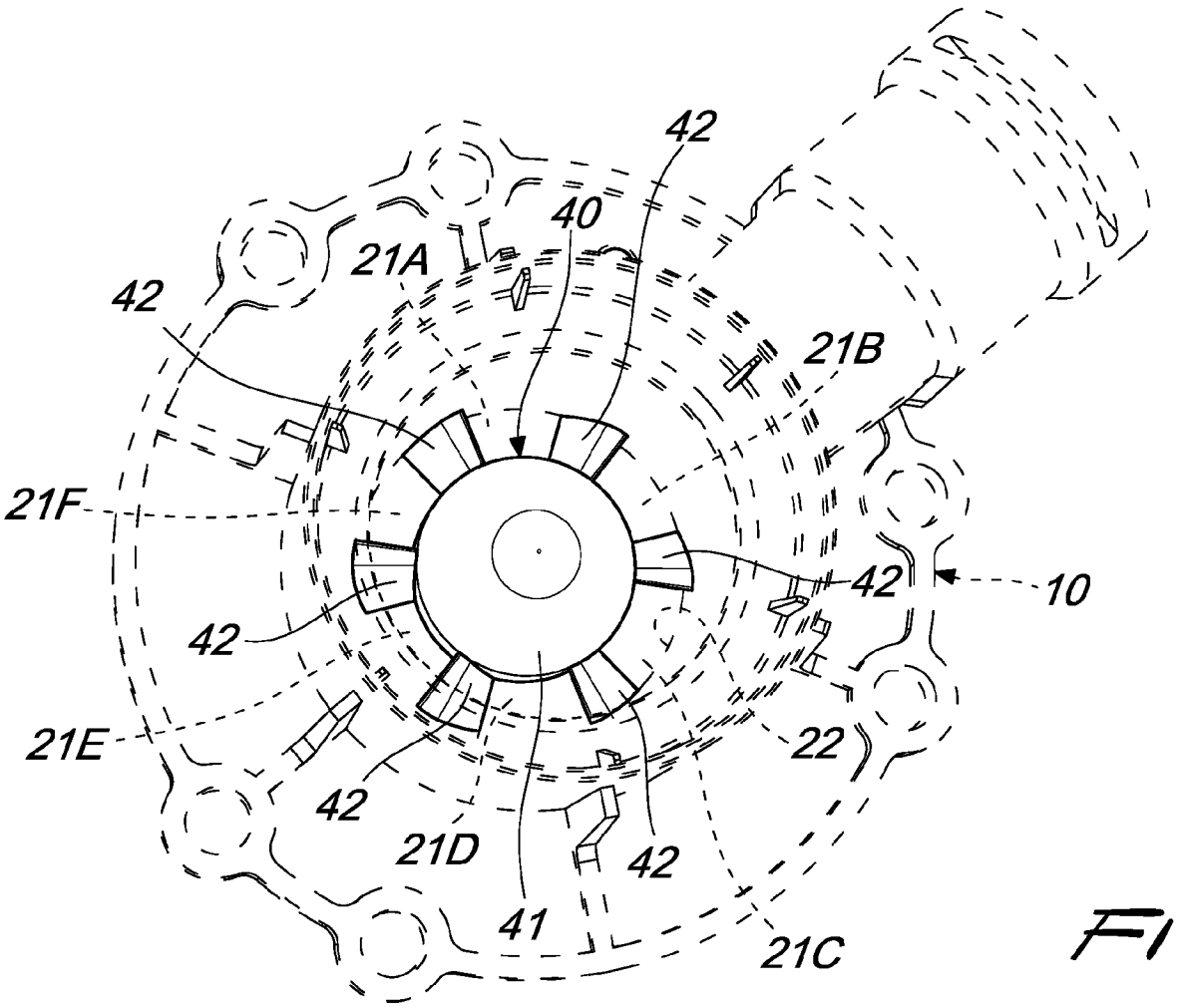
FIG. 6 is a perspective view of the feeder device in which only the flow diverter is drawn in solid lines.

In greater detail, this central protrusion 41 has a shape that diverges in the direction of the gas discharge opening 31, having for example the shape of a dome or hemisphere or ogive or cone or frustum or the like; in the preferred and illustrated embodiment, the central protrusion 41 has a substantially cone-like shape with a rounded vertex (as is evident from FIGS. 4 and 5).

As already mentioned, in the preferred embodiments, the flow diverter 40 also comprises a plurality of fins 42 which are inclined so as to impart a rotation and therefore a helical motion to the air that arrives from the air intake port 20.

Preferably, the fins 42 are arranged radially around the central protrusion 41, being preferably fixed thereto.

Conveniently, the fins 42 are mutually angularly equidistant.

Six fins 42 are present in the embodiment shown.

In practice, the fins 42 cause the rectilinear motion of the air arriving from the air intake port 20 to be converted into a helical motion with a pitch determined by the inclination of said fins 42, while the central protrusion 41 pushes the air outward, making it meet the gas that exits from the gas discharge opening 31; the combination of these two effects produces an advantageous mixing of the air with the gas already coming out of the conveyance body 10.

The fins 42 are conveniently inclined with respect to the advancement axis of the air, preferably by an angle comprised between 5 degrees and 85 degrees.

In some embodiments, including the one shown, the fins 42 connect the central protrusion 41 to the internal wall of the air passage 22, forming in the air discharge opening 21 a series of separate apertures 21A, 21B, 21C, 21D, 21E, 21F, which are therefore arranged along an annular region.

In greater detail, each one of these apertures 21A-21F is formed between two fins 42, the central protrusion 41 and the internal wall of the air passage 22. It should be noted that since the fins 42 are mutually angularly equidistant, all the apertures 21A-21F have the same size.

The total cross-section of the air passage opening 21 (i.e., the total sum of the cross-sections of the openings 21A-21F) is sized according to the type of boiler for which the feeder device 1 is intended, by calculating, in a known manner, the passage area as a function of the power of the boiler. As a result, the cross-section of the air passage 22 (upstream of the flow diverter 40) is greater than in the background art in which the flow diverter 40 is not present.

Preferably, the central protrusion 41 and the fins 42 are part of a single monolithic piece which forms the flow diverter 40; even more preferably, the entire air-gas conveyance body 10, comprising also the flow diverter 40, is provided in a single monolithic piece.

It should be noted that in the preferred and illustrated embodiment the air discharge openings 21 and the gas discharge openings 31 are at one end of a tubular portion of the conveyance body 10 that protrudes from the coupling wall of the flange 50, so that when the conveyance body 10 is coupled to the boiler in the condition for use this protruding tubular portion is inserted in the intake duct of the boiler.

The operation of the air and gas feeder device 1 is clear and evident from what has been described.

In particular, it is clear that the flow diverter 40 produces an outward redirection and at the same time a rotation of the air flow in output which, in combination, produce the mixing of the air in output from the air discharge opening 21 with the gas in output from the gas discharge opening 31; this mixing therefore occurs before the air and gas flow interacts with the fan present in the intake duct of the boiler.

Ultimately, therefore, the air and gas flows exit from a same exit plane, towards the intake duct of the boiler, but not parallel to each other: the air flow exits with a divergent helical motion, mixing with the gas flow.

The present invention also relates to a gas boiler (not shown) comprising, in a known manner, an intake duct for the intake of gas and air which comprises in turn an impeller of a fan configured to rotate in an intake direction.

According to the invention, the boiler comprises an air and gas feeder device 1, of the type just described, coupled to an intake port of the intake duct, so that the air and gas flow in output from said feeder device 1 is directed into the intake duct.

In this feeder device 1, the flow diverter 40 is configured to impart to the air flow in output from the air discharge opening 21 a rotation in the direction that is concordant with the intake direction of the impeller, i.e., the fins 42 are inclined so as to impart to the air flow a helical trajectory in which the air rotates in the same direction in which the impeller rotates during intake.

In this manner, turbulences are minimized and a more homogeneous mixing is obtained.

In practice it has been found that the air and gas feeder device for gas boilers, according to the present invention, fully achieves the intended aim and objects since it allows to improve the quality of the mixing of the air and gas entering the boiler.

Another advantage of the air and gas feeder device, according to the invention, resides in that it ensures a mixing of air and gas that is homogeneous over time.

An additional advantage of the air and gas feeder device according to the invention resides in that it reduces the turbulences in the air and gas flow, thus allowing to improve the homogeneity of the flame.

Another advantage of the air and gas feeder device, according to the invention, is that it is easy to provide and economically competitive if compared with the background art.

The air and gas feeder device for gas boilers thus conceived is susceptible of numerous modifications and variations, all of which are within the scope of the accompanying claims.

All the details may furthermore be replaced with other technically equivalent elements.

In practice, the materials used, as well as the contingent shapes and dimensions, may be any according to the requirements and the state of the art. In practice, the materials used as well as the contingent shapes and dimensions may be any according to the requirements and the state of the art.

The disclosures in Italian Patent Application No. 102020000004048 from which this application claims priority are incorporated herein by reference.

The invention claimed is:

1. An air and gas feeder device for gas boilers, comprising an air-gas conveyance body comprising:

a boiler coupling face configured to be coupled to a boiler at an intake duct of a boiler;

an air intake port connected to an air discharge opening by means of an air passage, said air discharge opening leading out from said boiler coupling face;

a gas intake port, configured to be fixed to a gas dispensing duct in fluid communication with a gas discharge opening, which leads out from said boiler coupling face;

wherein the air discharge opening is coaxial to, and at least partially surrounded by, the gas discharge opening;

wherein said air passage accommodates a flow diverter configured to divert an air flow in output from the air discharge opening in the direction of the gas in output from the gas discharge opening and to impart a rotation to said air flow;

wherein said air discharge opening is formed between the flow diverter and an internal wall of the air passage.

2. The air and gas feeder device according to claim 1, wherein the air discharge opening comprises a plurality of separate openings arranged along an annular region.

3. The air and gas feeder device according to claim 1, wherein the flow diverter is arranged so as to be radially centered in the air passage.

4. The air and gas feeder device according to claim 1, wherein the flow diverter comprises a central protrusion which protrudes toward the air intake port so as to divert radially outward the air that arrives from the air intake port.

5. The air and gas feeder device according to claim 4, wherein the central protrusion is shaped like a dome or hemisphere or ogive or cone or frustum.

6. The air and gas feeder device according to claim 1, wherein the flow diverter comprises a plurality of fins which are inclined so as to impart a rotation to the air that arrives from the air intake port.

7. The air and gas feeder device according to claim 6, wherein the fins are arranged radially around the central protrusion.

8. The air and gas feeder device according to claim 7, wherein the fins connect the central protrusion to an internal wall of the air passage, forming in the air discharge opening a series of separate apertures.

9. A gas boiler comprising an intake duct for the intake of gas and air which comprises an impeller of a fan configured to rotate in an intake direction, and further comprising an air and gas feeder device according to claim 1, which is coupled to an intake port of the intake duct, wherein the flow diverter is configured to impart to the air flow in output from the air discharge opening a rotation in the direction that is concordant with the intake direction of the impeller.

* * * * *